US005575505A

United States Patent [19]

Bridges

[11] Patent Number: 5,575,505

[45] Date of Patent: Nov. 19, 1996

[54] PAMPHLET WITH ENHANCED SPINE

[76] Inventor: Donald Y. Bridges, 3014 Creek Ct., Roswell, Ga. 30075

[21] Appl. No.: 513,079

[22] Filed: Aug. 9, 1995

[51] Int. Cl.[6] ..... B42D 3/00

[52] U.S. Cl. ..... 281/36; 281/21.1; 281/29

[58] Field of Search ..... 281/36, 21.1, 29, 281/51; 412/8, 901, 37

[56] References Cited

U.S. PATENT DOCUMENTS

| | | | |
|---|---|---|---|
| 3,169,029 | 2/1965 | Margolis | 281/29 |
| 4,284,227 | 8/1981 | Corey | 229/1.5 R |
| 4,537,544 | 8/1985 | Joost | 412/5 |
| 4,928,995 | 5/1990 | Pickering et al. | 281/29 |
| 4,934,738 | 6/1990 | Colonna | 281/28 |
| 5,178,414 | 1/1993 | Small et al. | 281/35 |
| 5,183,294 | 2/1993 | Jukola et al. | 281/23 |
| 5,407,230 | 4/1995 | Brink et al. | 281/15.1 |

*Primary Examiner*—Frances Han
*Attorney, Agent, or Firm*—Jones & Askew

[57] ABSTRACT

A thin pamphlet or book cover, with a flat spine portion in a 'T' configuration that is made from a single sheet of material folded four times.

12 Claims, 3 Drawing Sheets

11
24
12
18
16
4
14
25
21
10
4

12
21
11
25
16
17
18
30
14
13
15
19

PAMPHLET WITH ENHANCED SPINE

TECHNICAL FIELD

The present invention relates to a sheet of material such as paper (or the like) which is folded four times to create a thin pamphlet, or brochure, with front and back panels, and in particular with a spine in a T-shaped formation allowing the pamphlet or brochure to be easily visible when stored on a bookshelf.

BACKGROUND ART

Information such as advertising is frequently distributed in the form of a thin pamphlet or brochure. The disadvantage of disseminating information in this way is that when such a pamphlet is filed or stored on a bookshelf, it is difficult to notice or find the pamphlet amongst other books or files occupying the same shelf because the spine portion is thin and does not stand out for easy recognition.

Folders constructed from a single blank of material are already known in the art. Such a folder or binder is shown in U.S. Pat. No. 4,537,544, (Method of Forming A Folder For Reports or Statements of Account and Cover To Effect The Method). These folders are typically formed from a single sheet of material and adhesive is applied in the center spine portion so that papers may be fastened into place. Although such folders are useful for collectively and securely holding papers in place, they do not, however, provide an enhanced spine region specifically created to facilitate recognition of the folder amongst other materials on a book shelf.

Other folders and binders exist that are useful for holding papers in place according to various organizational needs. One such folder is shown in U.S. Pat. No. 4,284,227 (Expansion Folder With Accordian Pleat Backbone) where a file folder is constructed with a special type of spine that allows for expansion of the backbone in an accordion type fashion. The main purpose of this special feature is to allow for changes in the holding capacity of the folder so that varying quantities of papers can be efficiently stored.

Various other sorts of folders also exist: for example, those with specialized clasping mechanisms (U.S. Pat. No. 4,934,738: Combined Document Binder and Cover Holder), with special adhesive portions (U.S. Pat. No. 4,928,995: Bindable Cover Folders) and those specially constructed for particular contents (U.S. Pat. No. 5,407,230: Print Folder.) However, the spine has the same thickness as the contents in each of these devices.

Therefore, there has been a need for type of pamphlet or brochure with an enhanced spine region facilitating recognition of a thin pamphlet or brochure when it is filed or stored with other materials in a bookshelf.

SUMMARY OF THE INVENTION

The present invention provides a thin pamphlet or brochure with an enhanced spine region that allows it to be easily located on a bookshelf.

In a preferred embodiment of the invention, the special spine is essentially formed by four folds in the same single sheet of material that forms the brochure. First a central spine is formed by a central panel. On both sides of the central elongate panel, one more fold is created, creating a pair of connecting panels extending between the central panel and main front and back panels. The width of the connecting panels should not exceed one half of the width of the central panel. The connecting panels are folded inwardly toward the central panel in a position approximately parallel to the central panel. This results in the formation of a 'T' shaped spine for the pamphlet. A pamphlet thus constructed could be preprinted and shipped flat.

In an alternative embodiment of the invention, additional pages are affixed into the pamphlet by adhering them to one of the edges of either the main front panel or the main back panel.

In an another alternative embodiment of the invention, additional pages are affixed into the pamphlet by adhering them into the spine of the pamphlet itself.

Thus, a brochure or pamphlet that is constructed according to the present invention supplies the brochure with an exaggerated spine region which can be labeled, thereby allowing the brochure to be easily recognized even when placed with other materials on a bookshelf.

Thus, it is an object of the present invention to provide a pamphlet or brochure, or cover, with an enhanced spine.

It is a further object of the present invention to provide a pamphlet or brochure, or cover, with an enhanced spine constructed from a single sheet of material.

It is a further object of the present invention to provide a pamphlet or brochure with an enhanced spine constructed from a single sheet of material, within which additional pages may be affixed.

DETAILED DESCRIPTION

Figure 1:
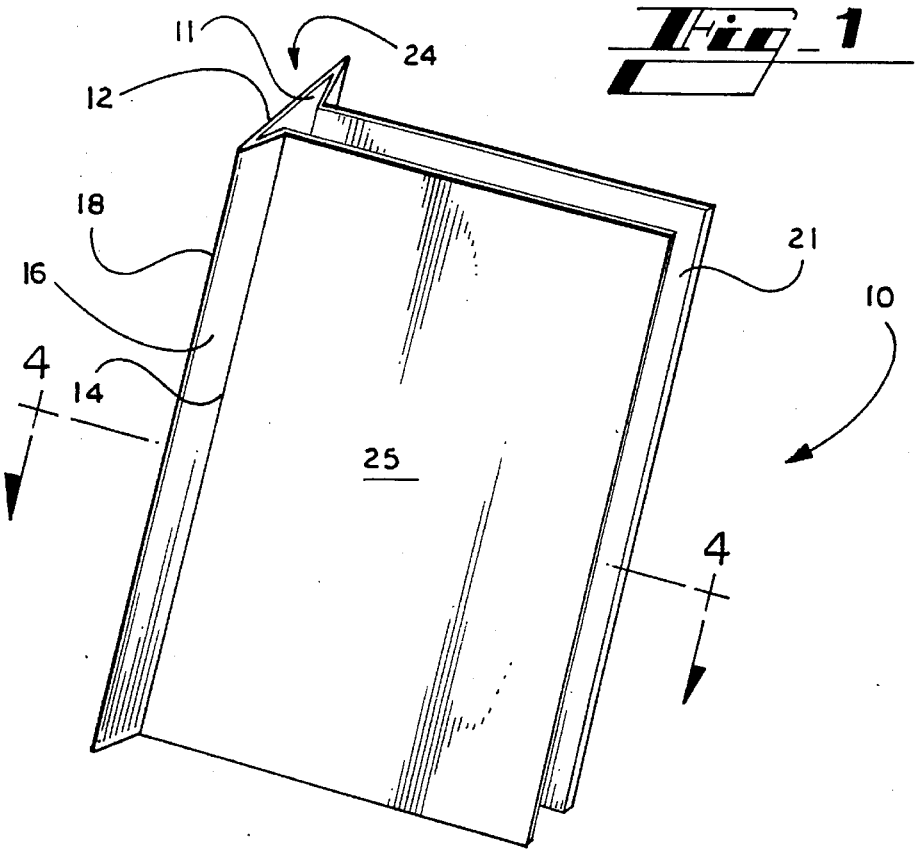
FIG. 1 is a pictorial view of a pamphlet embodying the present invention, viewed from an angle so that the enhanced T-shaped spine is visible.
Figure 2:
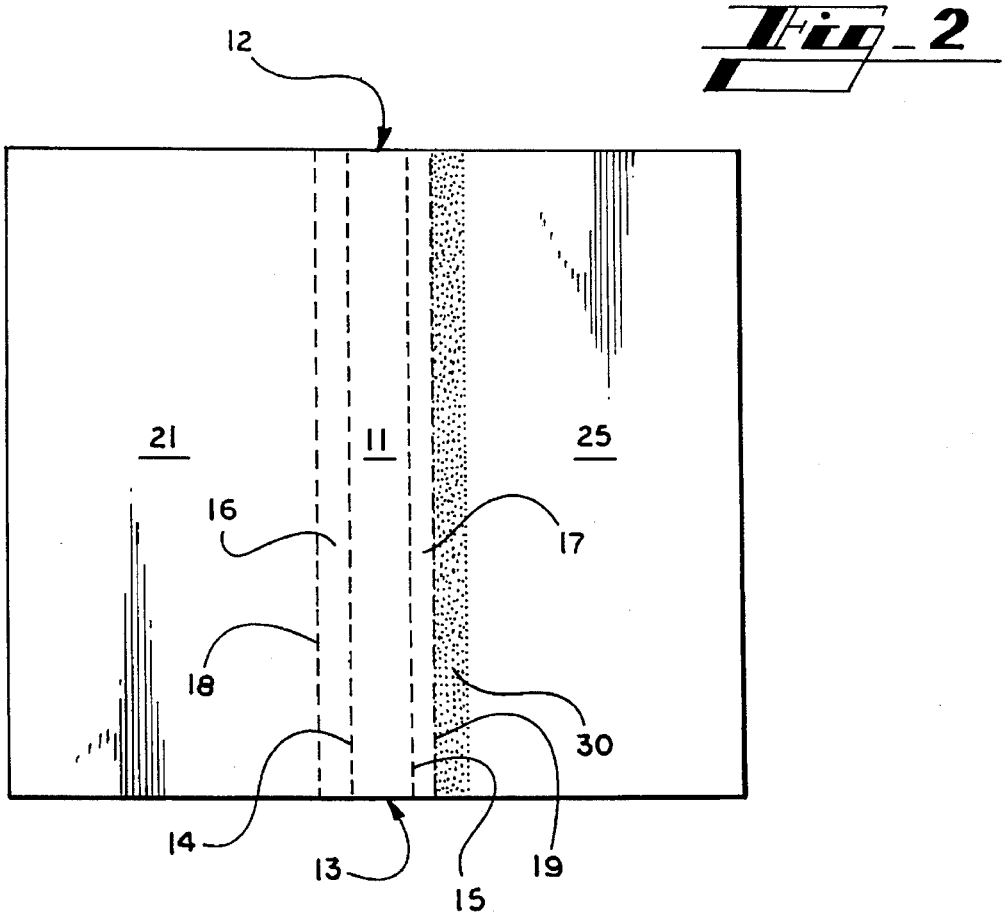
FIG. 2 is a plan view of the inside surface of a flat blank from which a pamphlet embodying the present invention is formed.
Figure 3:
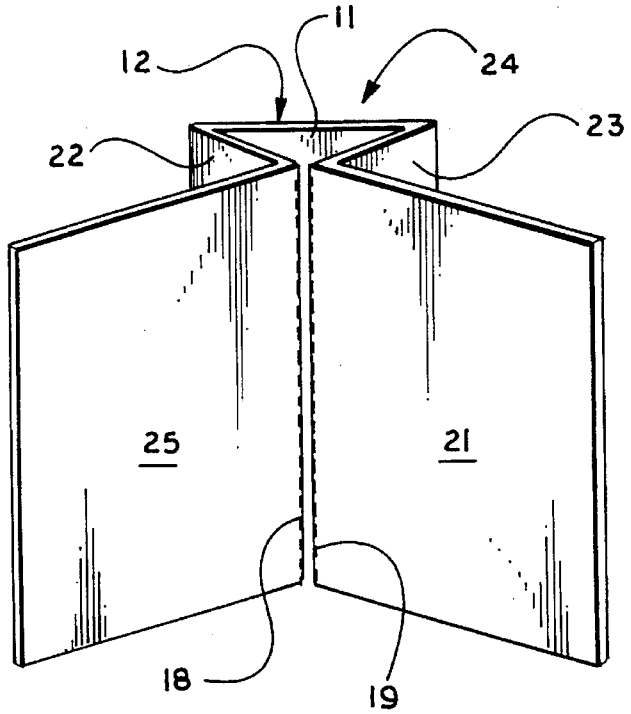
FIG. 3 is pictorial view of a pamphlet embodying the present invention, viewed with front and back panels open, showing relative sizes of spine in correlation to size of the panels.

Referring now in more detail to the drawing, in which like numerals refer to like parts throughout the several views. FIG. 1 shows a pamphlet 10 embodying the present invention. A blank 26 for forming the pamphlet is shown in FIG. 2. An open view of the pamphlet 10 is shown in FIG. 3.

The pamphlet 10 preferably is constructed from a single sheet of paper, paperboard, plastic, or the like, forming the blank 26, the inside surface of which is viewed in FIG. 2. The blank 26 is rectangular, and defines a top edge 12 and a bottom edge 13. The pamphlet is formed by dividing the blank into various panels. An elongate central panel 11 is formed spanning the height of the blank from its top edge 12 to its bottom edge 13. A pair of fold lines or scores, 14 and 15, extend along the longitudinal edges of the central panel 11, and foldably connect the central panel to a front connecting panel 16 and a back connecting panel 17, respectively. The connecting panels 16 and 17 each have a width no more than half the width of the central panel 11, and preferably have a width approximately equal to half the width of the central panel.

A front main panel 21 and a back main panel 25 are foldably connected to the connecting panels 16 and 17 along fold lines or scores 18 and 19, respectively. The width of the main panels may be varied depending on the nature of the information to be presented.

Optionally, a strip of pressure-sensitive adhesive 30 may be provided along one or both of the main panels, for retaining additional sheets of paper or the like. In FIG. 2, a single strip of adhesive 30 is placed on the back main panel 25 immediately adjacent to the connecting panel 17. The adhesive may be the well-known releasable paper adhesive marketed by 3M Corporation.

Figure 8:
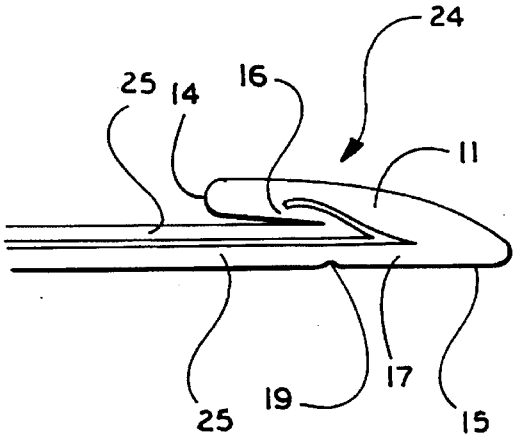
FIG. 8 is a top view of the invention that shows the configuration of the pamphlet in a flat position suitable for shipment.

In order to completely assemble the pamphlet 10 from the blank 26 four folds are required. For shipping purposes however, only three folds are necessary so that the pamphlet may be shipped flat. The front connecting panel 16 and front main panel 21 are folded about fold line 14 inwardly onto the central panel and lie approximately parallel thereto. The front main panel 21 is then folded about fold line 18 in a direction away from the central panel 11, until it rests on the outer surface of the front connecting panel 16. The back connecting panel 17 and back main panel 25 are then folded about fold line 15 inwardly onto the central panel and the front main panel 21. Following the three preceding folds, the pamphlet is flat as shown in FIG. 8, and is suitable for shipping. One more additional fold, of the back main panel 25 about the fold line or score 19 to a position approximately perpendicular to the central and connecting panels, results in the complete erection of the pamphlet. In the erected configuration, both connecting panels 16 and 17 are positioned approximately parallel to the central panel 11. It should be noted that the line 19 preferably is pre-folded or scored prior to shipment in the configuration of FIG. 8, to make the final fold easy for the user.

Figure 5:
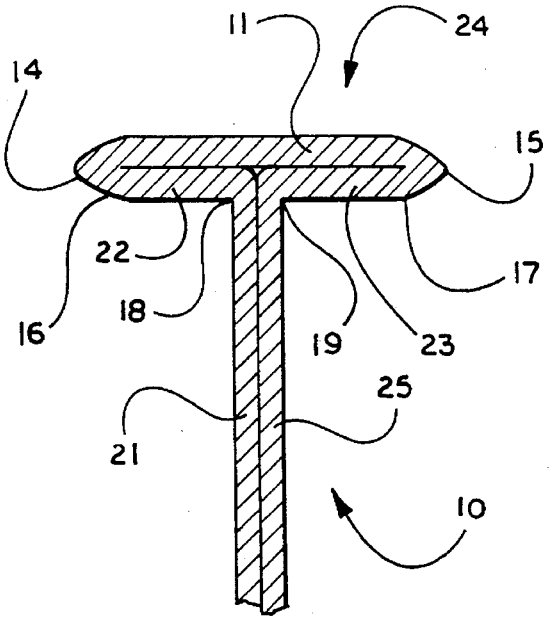
FIG. 5 is a exaggerated top cross sectional view taken along line 4—4 of FIG. 1.

The configuration of the pamphlet following complete assembly and erection is such that the inside of both the front main panel 21 and the back main panel 25 are positioned face to face, with the connecting panels 16 and 17 folded almost flat against the inside surface of the central elongate panel 11 in a position approximately parallel to it. These panels form a T-shaped enhanced spine region 24, having the width of the central panel 11 even when the thickness of the main panels and any sheets placed therebetween is much smaller. For example, FIG. 5 shows a brochure 10 in which the main panels 21 and 25 are the only sheets of the brochure. Despite the lack of thickness of the main panels, when the brochure is inserted between other materials (shown in phantom in FIG. 5) on a bookshelf, the spine 24 will tend to remain perpendicular to the main panels. Thus, printed indicia on the central panel 11 will remain readable and the brochure will be easier to locate on the bookshelf.

Figure 6:
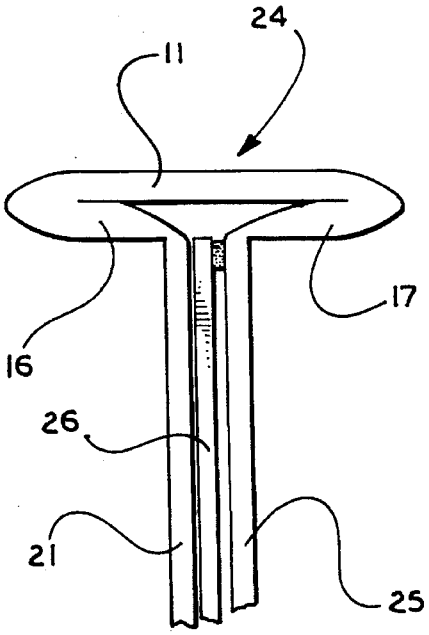
FIG. 6 is a exaggerated top cross sectional view showing an alternate embodiment including an internal page affixed along one of the main panels.

In a modified embodiment shown in FIG. 6, an additional page 26 is added to the pamphlet by affixing it to the adhesive 30. It will be understood that the unitary piece 10 shown in FIGS. 1–3 may function as a cover to additional pages inserted within the main panels. A single additional sheet may be added, as shown in FIG. 6, or a bundle of sheets. When used as a cover, the unit 10 may advantageously be made of a thicker material, such as paperboard or plastic, to better protect the interior pages.

Figure 4:
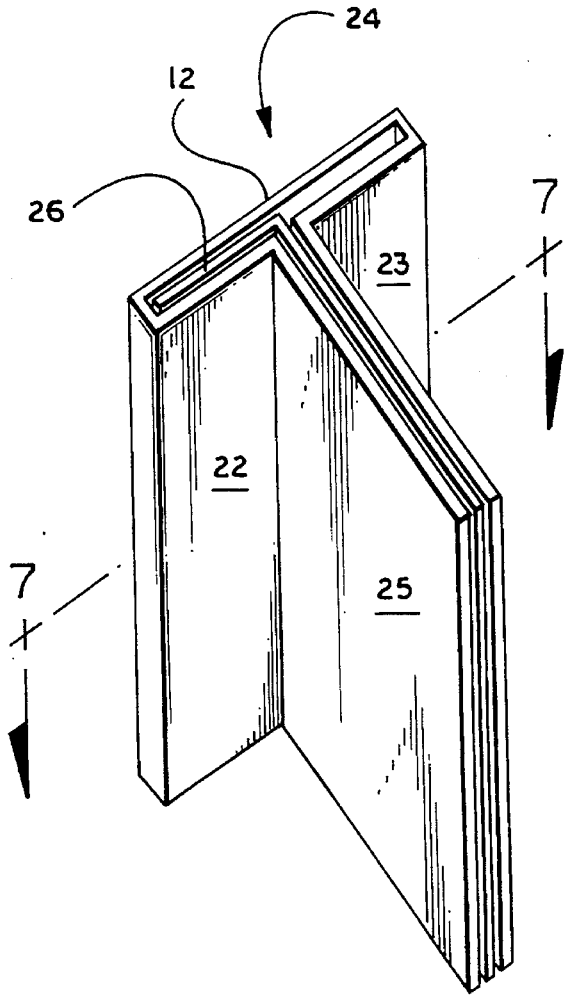
FIG. 4 is a pictorial view of a pamphlet embodying the present invention with one additional page inserted by fixation onto the spine, and with both front and back panels closed.
Figure 7:
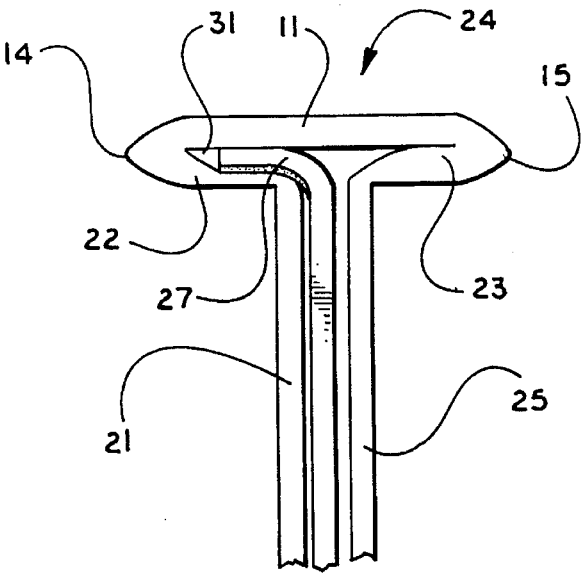
FIG. 7 is a exaggerated top cross sectional view taken along line 7—7 of FIG. 4, showing an alternate embodiment including an internal page affixed between one connecting panel and the spine.

FIGS. 4 and 7 shows an alternate manner in which an additional page 27 may be added to the pamphlet by capturing it in the spine between the connecting panel 16 and the central panel 11. The additional page (or pages) may be secured by adhesive 31 either to the central panel 11 or one of the connecting panels, with an edge of the pages adjacent to the fold line between the central panel and a connecting panel. During assembly the additional pages 27 are folded with the panels as required, resulting in the configuration of FIG. 7 when the pages are attached adjacent to the fold line 14, to either the front connecting panel 16 or the central panel 11, or both.

Reference has been made to folding locations as fold lines or score lines. One skilled in the art would appreciate that score lines or pre-folding may provide ease of use, but are not always necessary to make a brochure or cover according to this invention. For example, when the invention is embodied in a paper brochure, conventional machinery may be able to fold the paper along the indicated fold lines without any pre-scoring or folding. Furthermore, the panels of an article embodying the invention may be foldably connected by hinges, and may themselves be made of rigid material.

It should also be noted that an enhanced spine can be provided, if desired, on only one side of the main panels. This would be accomplished by eliminating one of the connecting panels, such as the back connecting panel 17. The width of the remaining connecting panel could be adjusted depending on the thickness of any pages inserted between the main panels. The resulting configuration would be L-shaped rather than T-shaped as shown.

While this invention has been described in detail with particular reference to a preferred embodiment thereof, it will be understood that variations and modifications can be made without departing from the spirit and scope of the invention as described in the following claims:

What is claimed is:

1. A pamphlet, comprising:

a T-shaped spine comprising an elongate central panel foldably connected along opposite edges to a pair of connecting panels, said connecting panels having a width less than or equal to half the width of the central panel and being folded inwardly to a position approximately parallel to the central panel; and a pair of main panels each foldably connected to one of the connecting panels.

2. A pamphlet as in claim 1 further comprising additional pages attached to one of the main panels.

3. A pamphlet as in claim 1 further comprising additional pages attached within the spine between the central panel and one of the connecting panels.

4. A pamphlet as in claim 1, wherein said connecting panels each have a width approximately equal to one-half the width of the central panel.

5. A pamphlet as in claim 4, wherein said main panels are positioned directly adjacent to one another.

6. A pamphlet as in claim 1, wherein said panels are formed from a single sheet of foldable material.

7. A pamphlet as in claim 6, wherein said single sheet of material comprises paper.

8. A pamphlet as in claim 6, wherein said single sheet of material comprises paperboard.

9. A pamphlet as in claim 6, wherein said single sheet of material comprises plastic.

10. A folded article for use as a brochure, cover, or the like, comprising:

a spine comprising an elongate central panel foldably connected to at least one connecting panel having a width less than the width of the central panel and being folded inwardly to a position approximately parallel to the central panel; and a pair of main panels each foldably connected to said spine and extending approximately perpendicularly from said spine, one of the main panels being foldably connected to the at least one connecting panel.

11. A booklet, comprising:

a cover, comprising:

a spine comprising an elongate central panel foldably connected to at least one connecting panel having a width less than the width of the central panel and being folded inwardly to a position approximately parallel to the central panel; and a pair of main panels each foldably connected to said spine and extending approximately perpendicularly from said spine, one of the main panels being foldably connected to the at least one connecting panel;

at least one interior page secured within said cover.

12. A booklet as in claim 11, wherein said spine includes a pair of said connecting panels, each having a width less than or equal to half the width of said central panel and being folded inwardly to a position approximately parallel to said central panel so as to form a T-shaped cover with said central panel and said main panels.

* * * * *